US007341963B2

(12) United States Patent
Wenstrup et al.

(10) Patent No.: US 7,341,963 B2
(45) **Date of Patent: *Mar. 11, 2008**

(54) NON-WOVEN MATERIAL WITH BARRIER SKIN

(75) Inventors: David E. Wenstrup, Greer, SC (US); Gregory J. Thompson, Simpsonville, SC (US)

(73) Assignee: Milliken & Company, Spartanburg, SC (US)

( * ) Notice: Subject to any disclaimer, the term of this patent is extended or adjusted under 35 U.S.C. 154(b) by 85 days.

This patent is subject to a terminal disclaimer.

(21) Appl. No.: 11/130,749

(22) Filed: May 17, 2005

(65) Prior Publication Data

US 2006/0264142 A1 Nov. 23, 2006

(51) Int. Cl.
*B32B 7/02* (2006.01)
*D04H 1/54* (2006.01)

(52) U.S. Cl. ..... 442/415; 442/409; 442/411; 442/414; 428/212; 428/218

(58) Field of Classification Search ..... 442/389, 442/409, 411, 414, 415; 428/212, 218
See application file for complete search history.

(56) References Cited

U.S. PATENT DOCUMENTS

| | | | | |
|---|---|---|---|---|
| 3,073,735 | A | 1/1963 | Till et al. | 156/38 |
| 3,740,797 | A | 6/1973 | Farrington | 19/156.3 |
| 3,772,739 | A | 11/1973 | Lovgren | 19/156.3 |
| 3,837,995 | A | 9/1974 | Floden | 161/150 |
| 4,018,646 | A | 4/1977 | Ruffo et al. | 162/146 |
| 4,082,886 | A | 4/1978 | Butterworth et al. | 428/284 |
| 4,127,698 | A | 11/1978 | Shimizu et al. | 428/373 |
| 4,194,037 | A | 3/1980 | Stoller | 429/92 |
| 4,435,468 | A | 3/1984 | TenEyck | 428/285 |
| 4,863,797 | A | 9/1989 | Ichibori et al. | 428/359 |
| 4,931,357 | A | 6/1990 | Marshall et al. | 442/415 |
| 4,970,111 | A | 11/1990 | Smith, Jr. | 428/283 |
| 5,173,355 | A | 12/1992 | Vock et al. | 428/219 |
| 5,208,105 | A | 5/1993 | Ichibori et al. | 428/373 |
| 5,348,796 | A | 9/1994 | Ichibori et al. | 442/202 |
| 5,350,624 | A | 9/1994 | Georger et al. | 429/219 |
| 5,399,423 | A | 3/1995 | McCullough et al. | 428/287 |
| 5,407,739 | A | 4/1995 | McCullough et al. | 428/287 |
| 5,458,960 | A | 10/1995 | Nieminen et al. | 428/284 |
| 5,508,102 | A | 4/1996 | Georger et al. | 428/297 |
| 5,698,298 | A | 12/1997 | Jackson et al. | 428/198 |
| 5,723,209 | A | 3/1998 | Borger et al. | 428/219 |

(Continued)

FOREIGN PATENT DOCUMENTS

EP 0622332 11/1994

(Continued)

*Primary Examiner*—Jenna Befumo
(74) *Attorney, Agent, or Firm*—Terry T. Moyer; Cheryl J. Brickey; Jeffery E. Bacon

(57) ABSTRACT

A non-woven material including first effect fibers, first binder fibers, second binder fibers, and bulking fibers. The non-woven material has a first planar zone with an exterior skin, and a bulking zone. The first planar zone includes a greater concentration of first effect fibers and first binder fibers. The bulking zone includes a greater concentration of bulking fibers and second binder fibers. The first effect fibers can be fire retardant fibers.

12 Claims, 2 Drawing Sheets

U.S. PATENT DOCUMENTS

| | | | | |
|---|---|---|---|---|
| 5,766,745 | A | 6/1998 | Smith et al. | 428/218 |
| 5,856,243 | A | 1/1999 | Geirhos et al. | 442/57 |
| 5,942,288 | A | 8/1999 | Kajander | 427/389.7 |
| 6,346,491 | B1 | 2/2002 | DeAngelis et al. | 442/110 |
| 6,572,723 | B1 | 6/2003 | Tilton et al. | 156/219 |
| 6,586,353 | B1 | 7/2003 | Kiik et al. | 442/320 |
| 6,609,261 | B1 | 8/2003 | Mortensen et al. | 5/698 |
| 6,718,583 | B1 | 4/2004 | Diaz | 5/698 |
| 6,764,971 | B2 | 7/2004 | Kelly et al. | 442/408 |
| 6,797,653 | B2 | 9/2004 | Fay | 442/85 |
| 6,823,458 | B1 | 11/2004 | Lee et al. | 726/16 |
| 2003/0100239 | A1 | 5/2003 | Gaffney et al. | 442/354 |
| 2003/0106560 | A1 | 6/2003 | Griesbach et al. | 128/849 |
| 2003/0200991 | A1 | 10/2003 | Keck et al. | 134/6 |
| 2003/0224679 | A1 | 12/2003 | Ahluwalia | 442/72 |
| 2003/0228460 | A1 | 12/2003 | Ahluwalia | 428/315.5 |
| 2004/0060118 | A1 | 4/2004 | Diaz | 5/698 |
| 2004/0060119 | A1 | 4/2004 | Murphy et al. | 5/698 |
| 2004/0062912 | A1 | 4/2004 | Mason et al. | 428/139 |
| 2004/0091705 | A1 | 5/2004 | Hanyon et al. | 428/373 |
| 2004/0102112 | A1 | 5/2004 | McGuire et al. | 442/59 |
| 2004/0106347 | A1 | 6/2004 | McGuire et al. | 442/361 |
| 2004/0158928 | A1 | 8/2004 | Gladney | 5/698 |
| 2004/0185731 | A1 | 9/2004 | McGuire | 442/141 |
| 2004/0198125 | A1 | 10/2004 | Mater et al. | 442/394 |
| 2004/0242107 | A1 | 12/2004 | Collins | 442/403 |
| 2004/0242109 | A9 | 12/2004 | Tilton et al. | 442/415 |
| 2004/0259451 | A1 | 12/2004 | Paradis et al. | 442/381 |
| 2005/0023509 | A1 | 2/2005 | Bascom et al. | 252/608 |
| 2005/0026528 | A1 | 2/2005 | Forsten et al. | 442/414 |
| 2005/0176327 | A1* | 8/2005 | Wenstrup et al. | 442/357 |

FOREIGN PATENT DOCUMENTS

| | | |
|---|---|---|
| EP | 1195459 | 4/2002 |
| EP | 1300511 | 4/2003 |
| JP | 59186750 | 10/1984 |
| JP | 7040487 | 2/1995 |
| JP | 2002287767 | 10/2002 |
| WO | WO97/00989 | 1/1997 |
| WO | WO 01/31131 | 5/2001 |
| WO | WO 03/023108 | 2/2003 |
| WO | WO 2005/001187 | 1/2005 |

* cited by examiner

NON-WOVEN MATERIAL WITH BARRIER SKIN

BACKGROUND

The present invention generally relates to nonwoven materials with a voluminous z direction component which have a surface skin added on either one or both sides of the nonwoven.

There are a number of products in various industries, including automotive, office and home furnishings, construction, and others; that require materials having a z-direction thickness to provide thermal, sound insulation, aesthetic, and other performance features. In many of these applications it is also required that the material be thermoformable to a specified shape and rigidity. In the automotive industry these products often are used for shielding applications such as noise and thermal barriers in automotive hood liners and firewall barriers. These automotive materials may or may not have an aesthetic cover material incorporated into the part, which can also protect the core from abrasion, etc. In home and office furnishing, and construction applications these materials are often used as structural elements to which exterior decorative materials are added.

Additionally, these and other industries require that the materials deliver these properties in a cost effective manner. Often the barrier properties are best accomplished by using specialty fibers and or materials that generate a high level of performance, but also introduce significant cost to the substrate. Especially in a voluminous thickness substrate, the introduction of even a small percent of these materials into the shield material can introduce a significant level of cost to the overall substrate. For this reason composites having specialty surface layers are often used to provide these barrier properties. An example would be a thin layer of high cost but highly effective specialty material laminated to a voluminous lower cost core material. While the resulting composite costs less than more homogenous composites, there are disadvantages such as the need for additional processing steps and the potential delamination of the skin layer.

The present invention is an alternative to the prior art. It is a non-woven material with different functional zones to provide various desired properties of the material localized to the vertically oriented zones where required. Low melt fibers that can be used to construct a "skin" on one side of the non-woven material can be localized to the sides of the material specifically. The formation of this skin can provide a barrier between the atmosphere and the interior of the non-woven material, can provide a smoother more aesthetically pleasing surface, and can improve other performance features such as abrasion and sound absorption. In the case of a heat shield, the material can become oxygen-starved, due to the lower air permeability of the material skin and facilitate its flame resistance. The invention has superior molding performance because the low melt fibers can be not only optimized in quantity for superior performance, but can also be localized to optimize performance for specific mold design. Superior sound absorption is achieved by creating a distinct skin on the non-woven with lower air permeability than the core. By using low melt fibers of the same chemical nature as the voluminous core, an essentially single recyclable material can be achieved. All of these benefits are achieved at competitive costs and weight compared to the existing products.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
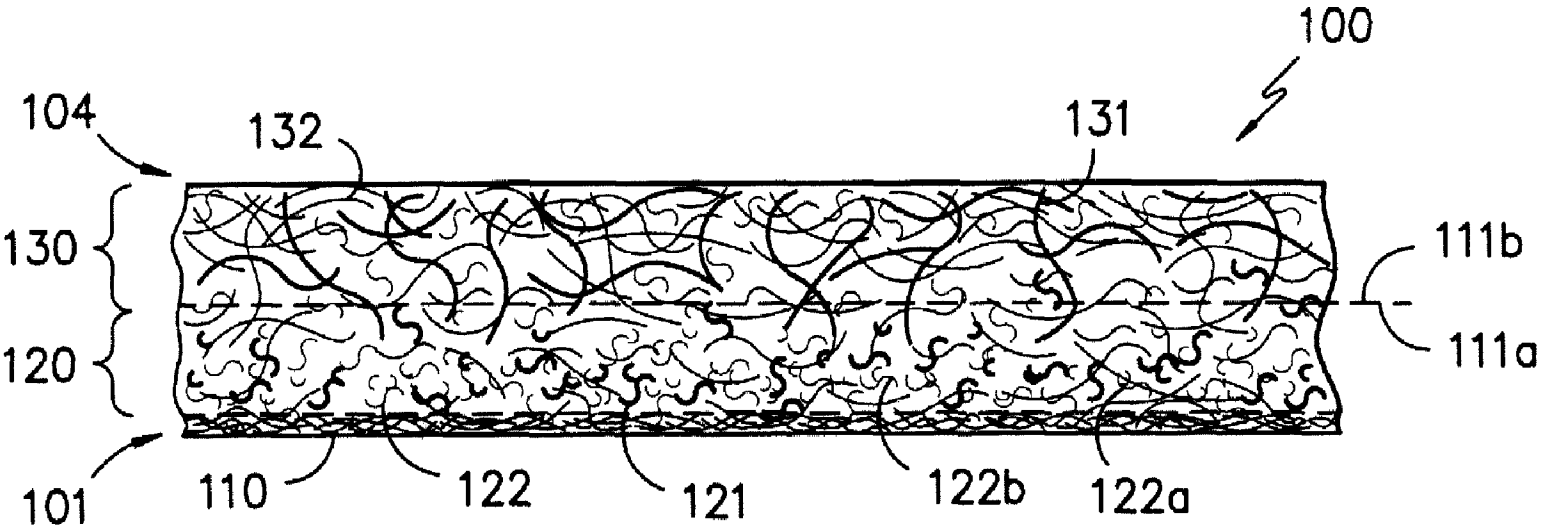
FIG. 1 shows an enlarged cross-section of one embodiment of a non-woven material of the present invention; and, FIG. 2 shows a diagram of a machine for performing a process for forming the non-woven material of the present invention.

Referring now to the figures, and in particular to FIG. 1, there is shown an enlarged cross-sectional view of a non-woven material 100 illustrating an embodiment of the present invention. As Illustrated, the non-woven material 100 generally includes first binder fibers 121, first effect fibers 122, second binder fibers 131, and bulking fibers 133.

As used herein, binder fibers are fibers that form an adhesion or bond with the other fibers. Binder fibers can include fibers that are heat activated. Examples of heat activated binder fibers are fibers that can melt at lower temperatures, such as low melt fibers, core and sheath fibers with a lower sheath melting temperature, and the like. In one embodiment, the binder fibers are a polyester core and sheath fiber with a lower melt temperature sheath. A benefit of using a heat activated binder fiber as the second binder fiber 131 in the non-woven material 100, is that the material can be subsequently molded to part shapes for use in automotive hood liners, engine compartment covers, ceiling tiles, office panels, etc.

As used herein, effect fibers are any additional fibers which may be beneficial to have concentrated near the surface. These effect fibers may be used to impart color or functionality to the surface.

Bulking fibers are fibers that provide volume in the z direction of the nonwoven material, which extends perpendicularly from the planar dimension of the non-woven material 100. Types of bulking fibers would include fibers with high denier per filament (5 denier per filament or larger), high crimp fibers, hollow-fill fibers, and the like. These fibers provide mass and volume to the material. Examples of fibers used as bulking fibers 133 include polyester, polypropylene, and cotton, as well as other low cost fibers.

The non-woven material 100 includes a first planar zone 120 and a bulking planar zone 130. The first planar zone 120 has a first boundary plane 101 located at the outer surface of the non-woven material 100, and an inner boundary plane 111*a* located nearer to the bulking planar zone 130 than the first boundary plane 101. The bulking planar zone 130 has a second boundary plane 104 located at the outer surface of the non-woven material 100 and an inner boundary plane 111*b* located nearer to the fire retardant planar zone 120 than the second boundary plane 104. The non-woven material 100 is a unitary material, and the boundaries of the two zones do not represent the delineation of layers, but rather areas within the unitary material. Because the non-woven material 100 is a unitary material, and the first planar zone 120 and the bulking planar zone 130 are not discrete separate layers joined together, various individual fibers will occur in both the first planar zone 120 and the bulking planar zone 130. Although FIG. 1 illustrates the first planar zone 120 as being a smaller thickness in the z-direction than the bulking planar zone 130, the relative thickness of the two zones can be different than as shown.

The first planar zone 120 contains first binder fibers 121, first effect fibers 122, second binder fibers 131, and bulking fibers 133. However, the first planar zone 120 primarily contains the first binder fibers 121 and the first effect fibers 122. As such, the first planar zone 120 can have a greater concentration of the first binder fibers 121 than the bulking planar zone 130, and the first planar zone 120 can have a greater concentration of the first effect fibers 122 than the bulking planar zone 130. Additionally, the distribution of the fibers in the first planar zone 120 is such that the concentration of the first binder fibers 121 and the first effect fibers 122 is greater at the first boundary plane 101 of the first planar zone 120 than the inner boundary plane 111*a* of that zone. Moreover, it is preferred that the concentration of the first effect fibers 122 and the first binder fibers 121 decreases in a gradient along the z-axis from the first boundary plane 101 to the inner boundary plane 111*a* of that zone.

The bulking planar zone 130 also contains second binder fibers 121, first effect fibers 122, second binder fibers 131, and bulking fibers 133. However, the bulking planar zone 130 primarily contains the second binder fibers 131 and the bulking fibers 133. As such, the bulking planar zone 130 can have a greater concentration of the second binder fibers 131 than the first planar zone 120, and the bulking planar zone 120 can have a greater concentration of the bulking fibers 132 than the first planar zone 120. Furthermore, the distribution of the fibers in the bulking planar zone 130 is such that the concentration of the bulking fibers 133 is greater at the second boundary plan 104 than the inner boundary plane 111*b* of that zone. Additionally, it is preferred that the concentration of the bulking fibers 133 decreases in a gradient along the z-axis from the second boundary plane 104 to the inner boundary plane 111*b* of that zone.

Still referring to FIG. 1, one embodiment of the present invention includes a first skin 110 along the first boundary plane 101. The first skin 110 contains first binder fibers 121, wherein the first binder fibers 121 are melt bonded into the semi-rigid skin. The first skin 110 can also contain the first effect fibers 122, the second binder fiber 131, and the bulking fiber 133. However, the first skin 110 will contain lesser amounts of the second binder fiber 131 or the bulking fiber 133 than the first effect fiber 122 or the first binder fiber 121.

Figure 2:
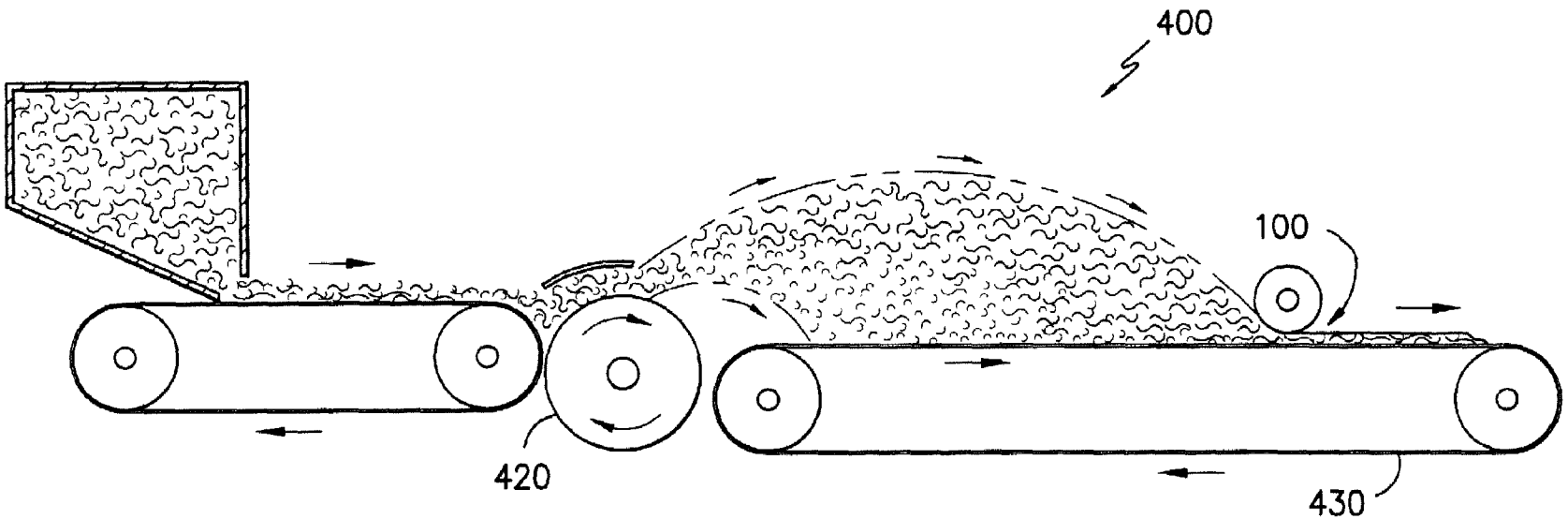

Referring now to FIG. 2, there is shown a diagram illustrating a process for forming the non-woven material 100 from FIG. 1. As illustrated in FIG. 2, air lay equipment 400 uses differences in the fibers to lay the fibers on a collection belt 430 with the concentration of each type of fiber varying in the z-direction, which is perpendicular to the plane of the non-woven material 100 as it lays on the collection belt 430. A commercially available piece of equipment that has been found satisfactory in this process to form the claimed invention is the "K-12 HIGH-LOFT RANDOM CARD" by Fehrer A G, in Linz, Austria.

Still referring to FIG. 2, in one embodiment, the varying concentration of the fibers in the non-woven material is accomplished by the types fibers having different deniers, which results in the fibers collecting on the collection belt 430 primarily at different locations. The fibers are projected along the collection belt 430 in the same direction as the travel direction of the collection belt 430. Fibers with a larger denier will tend to travel further than smaller denier fibers down the collection belt 430 before they fall to the collection belt 430. As such, there will tend to be a greater concentration of the smaller denier fibers closer to the collection belt 430 than larger denier fibers. Also, there will tend to be a greater concentration of the larger denier fibers farther from the collection belt 430 than smaller denier fibers. In such an embodiment, the first binder fibers 121 and the first effect fibers 122 have a smaller denier per filament than the second binder fibers 131 and the bulking fibers 132.

It has been found that a good distribution of fibers in the non-woven material can be accomplished by the first binder fibers 121 having a denier ranging from about 1 to about 4 deniers, the first effect fibers 122 having a denier ranging from about 1 to about 4 denier, the second binder fibers 131 having a denier greater than about 4 denier, and the bulking fibers 133 having a denier greater than about 4 denier. Selection of the denier of the various fibers must be such that the difference in the denier between the fibers primarily in the first zone 120 (the first binder fiber 121 and the first effect fiber 122) with the fibers primarily in the bulking zone 130 (the second binder fiber 131 and the bulking fiber 133), is sufficient to create the desired distribution and gradient of the fibers in the non-woven material 100. In one embodiment, the difference between the denier of fibers primarily in bulking zone 130 is at least about two times (2×) the denier or greater than the denier of the fibers primarily in the first zone 120.

Referring now to FIGS. 1 and 2, the first binder fibers 121, the first effect fibers 122, the second binder fibers 131, and the bulking fibers 133 are opened and blended in the appropriate proportions and delivered to a cylinder 420. The cylinder 420 rotates and throws the blended fibers towards the collection belt 430 whereby the fibers are collected as they fall from the throwing pattern. The spinning rotation of the cylinder 420 is such that larger denier fibers tend to travel further than the smaller denier fibers in the direction of travel for the collection belt 430 before resting on the collection belt 430. Therefore, the web of fibers collected on the collection belt 430 will have greater concentration of the smaller denier fibers adjacent to the collection belt 430 in the z-direction, and a greater concentration of the larger denier fibers further away from the collection belt 430 in the z-direction.

Still referring to FIGS. 1 and 2, in the non-woven material 100, the first binder fibers 121 and the first effect fibers 122 tend to have the greatest concentration point at or near the lower or first boundary plane 101 of the non-woven web that progressively decreases from the greatest concentration towards the upper or second boundary plane 104 of the non-woven web. The bulking fibers 133 typically have a greatest concentration point above the greatest concentration point at or near the upper or second boundary plane 104 of the non-woven web that progressively decreases from the greatest concentration towards the lower or first boundary plane 101 of the non-woven web. It is this distribution by the equipment 400 that creates the first planar zone 120 and the bulking planar zone 130 of the non-woven material 100.

Referring still to FIGS. 1 and 2, after the non-woven web is formed, it is heated so that the first binder fibers 121 at least partially melt bond with at least a portion of the first effect fibers 122, and so that the second binder fibers 131 are at least partially melt bond with at least a portion of the bulking fibers 133.

In the embodiment of the non-woven material 100 illustrated in FIG. 1, subsequent to the heating process, the first boundary plane 101 of the non-woven web is subjected to a heat treatment, such as a calendar or a heated belt, which causes the first binder fibers 121 at the first boundary plane 101 of the non-woven web to fuse together and with the first effect fibers 122 to form a skin surface. The skin surface formed on the first boundary plane 101 is first skin 110. It is to be noted, that the first skin 110 can also be achieved without the use of the first effect fibers 122 in the non-woven material 100, making the first skin 110 primarily formed of the first binder fibers 121. The fusing of material at the first boundary plane 101 to form the first skin 110, creates a material with reduced air permeability, improved sound absorption, and increased abrasion resistance as compared to similar material without a fused skin.

Referring now to FIG. 1, there are a number of different types of fibers which can be used for first effect fibers 122. These include fibers of color to give the nonwoven material 100 the desired aesthetic appearance. These effect fibers 122 can also include performance fibers such as chemical resistant fibers (such as polyphenylene sulfide and polytetrafluoroethylene), moisture resistant fibers (such as polytetrafluoroethylene and topically treated materials like polyester), fire retardant fibers, or others.

As used herein, fire retardant fibers shall mean fibers having a Limiting Oxygen Index (LOI) value of 20.95 or greater, as determined by ISO 4589-1. Types of fire retardant fibers include, but are not limited to, fire suppressant fibers and combustion resistant fibers. Fire suppressant fibers are fibers that meet the LOI by consuming in a manner that tends to suppress the heat source. In one method of suppressing a fire, the fire suppressant fiber emits a gaseous product during consumption, such as a halogenated gas. Examples of fiber suppressant fibers include modacrylic, PVC, fibers with a halogenated topical treatment, and the like. Combustion resistant fibers are fibers that meet the LOI by resisting consumption when exposed to heat. Examples of combustion resistant fibers include silica impregnated rayon such as rayon sold under the mark VISIL®, partially oxidized polyacrylonitrile, polyaramid, para-aramid, carbon, meta-aramid, melamine and the like.

In one example of the present invention, the non-woven material was formed from a blend of four fibers, including:

1) about 10% by weight of first binder fiber being from 1 to 2 denier low melt polyester;
2) about 60% by weight of the first effect fibers in the form of fire retardant fibers, including about 20% fire suppressant fiber being 2 denier modacrylic and about 40% fire retardant fiber including both 3.5 denier glass impregnated rayon and 2 denier partially oxidized polyacrylonitrile;
3) about 10% by weight of second binder fibers, being 4 denier and 10 denier low melt polyester; and
4) from about 15% to about 20% by weight of bulking fibers, being 15 denier polyester.

The fibers were opened, blended and formed into non-woven material 100 using a "K-12 HIGH-LOFT RANDOM CARD" by Fehrer AG. Specifically, the fibers are deposited onto the collecting belt of the K-12. After the fibers are collected, the non-woven web is heated to about 160° C. Upon cooling the bonded non-woven web, the web is then calendared on the side of the web containing the greater amount of the first binder fibers and the fire retardant first effect fibers. The calendaring process melt bonds the first binder fibers at first boundary plane 101 of the non-woven web into a semi-rigid skin that becomes a fire retardant skin. The resulting non-woven material had a weight per square yard from about 7 to about 10 ounces. In the resulting non-woven material, the fire retardant first effect fibers make up at least 40% of the non-woven material, and there are at least twice as many first binder fibers and fire retardant first effect fibers as compared with the bulking fibers and second binder fibers.

In a second example of the present invention, the non-woven material was formed from a blend of four fibers, including:

1) about 25% by weight of first binder fibers, being 1 denier low melt polyester fibers;
2) about 20% by weight of second binder fibers, being about equally split between 4 denier low melt polyester fibers and al 0 denier low melt polyester fibers; and
3) about 55% by weight of bulking fibers, being 15 denier polyester bulking fibers.

The fibers were opened, blended and formed into non-woven material 100 using a "K-12 HIGH-LOFT RANDOM CARD" by Fehrer AG. Specifically, the fibers are deposited onto the collecting belt of the K-12. After the fibers are collected, the non-woven web is heated to about 160° C. Upon cooling the bonded non-woven web, the web is then calendared on the side of the web containing the greater amount of the first binder fibers. The calendaring process melt bonds the first binder fibers at first boundary plane of the non-woven web into a semi-rigid skin that becomes the first skin. The resulting non-woven material had a weight per square yard from about 7 to about 10 ounces.

The second example of the present invention was tested for air permeability, sound absorption, and abrasion resistance, and compared to a non-woven with the same materials but no skin layer. Sound Absorption was tested according to ASTM E 1050 (ISO 10534-2), Air Permeability was tested according to ASTM D-737, and Martindale Abrasion was tested according to ASTM D-4966. The results of the testing are shown in the table below, where Article A is the non-woven material without a skin and Article B is the non-woven material with the skin:

TABLE 1

| | Sound Absorption @ | | | Air | Martindale |
|---|---|---|---|---|---|
| Sample | 500 Hz | 1000 Hz | 1500 Hz | Permeability | Abrasion |
| Article A | 15% | 29% | 44% | 198.5 | 5 |
| Article B | 19% | 42% | 64% | 147.0 | 8 |

As can be seen from the results in Table 1, the skin improves sound absorption, reduces air permeability, and improves abrasion resistance.

Although the previous examples describe a non-woven material having a weight of about 7 to 10 ounces per square yard, this weight can vary depending on the end use of the non-woven material. For example, the weight of the non-woven material can be from about 7 to about 15 ounces per square yard if the non-woven material is being used in the ceiling tile industry. Further, the weight of the non-woven material can be from about 15 to about 35 ounces per square yard if the material is being used in the automotive industry. The use of a weight from about 7 to about 10 ounces per square yard for the non-woven material is better suited for the mattress industry.

Although the present invention has been described in considerable detail with reference to certain preferred versions thereof, other versions are possible. Therefore, the spirit and scope of the appended claims should not be limited to the description of the preferred versions contained herein.

What is claimed is:

1. A non-woven material, comprising:

first binder fibers, bulking fibers, and second binder fibers;

wherein the non-woven material being a unitary material formed in a single process without joining together discrete separate layers having:

a first planar zone defined by a first boundary plane and an inner boundary plane, the first planar zone including a portion of the first binder fibers and the bulking fibers;

a bulking planar zone defined by a second boundary plane and said inner boundary plane, the bulking planar zone including a portion of the first binder fibers, the second binder fibers, and the bulking fibers;

a first semi-rigid skin at the first boundary plane formed by melt bonding the first binder fibers on the first boundary plane of the first planar zone, the first skin comprising the first binder fibers;

wherein concentrations of said first binder fibers in said first planar zone being greater than concentrations of the first binder fibers in said bulking planar zone, and the concentration of the first binder fibers decreases in a gradient from the first boundary plane to the inner boundary plane; and wherein concentrations of said bulking fibers being greater in said bulking planar zone than the concentration of the bulking fibers in said first planar zone, and the concentration of bulking fibers decreases in a gradient from the second boundary plane to the inner boundary plane.

2. A non-woven material, comprising:

first binder fibers, bulking fibers, and second binder fibers;

wherein the non-woven material being a unitary material formed in a single process without joining together discrete separate layers having:

a first planar zone defined by a first boundary plane and an inner boundary plane, the first planar zone including a portion of the first binder fibers and the second binder fibers;

a bulking planar zone defined by a second boundary plane and said inner boundary plane, the bulking planar zone including a portion of the first binder fibers, the second binder fibers, and the bulking fibers;

a first semi-rigid skin at the first boundary plane formed by melt bonding the first binder fibers on the first boundary plane of the first planar zone, the first skin comprising the first binder fibers;

wherein concentrations of said first binder fibers in said first planar zone being greater than concentrations of the first binder fibers in said bulking planar zone, and the concentration of the first binder fibers decreases in a gradient from the first boundary plane to the inner boundary plane; and wherein concentrations of said second binder fibers being greater in said bulking planar zone than the concentration of the second binder fibers in said first planar zone, and the concentration of second fibers decreases in a gradient from the second boundary plane to the inner boundary plane.

3. The non-woven according to claim 2, wherein the first planar zone includes a portion of the bulking fibers, the concentrations of said bulking fibers being greater in said bulking planar zone than the concentration of the bulking fibers in first planar zone, and the concentration of bulking fibers decreases in a gradient from the second boundary plane to the inner boundary plane.

4. A non-woven material, comprising:

first binder fibers, first effect fibers, bulking fibers, and second binder fibers;

wherein the non-woven material being a unitary material formed in a single process without joining together discrete separate layers having:

a first planar zone defined by a first boundary plane and an inner boundary plane, the first planar zone including a portion of the first binder fibers, the first effect fibers, and the bulking fibers;

a bulking planar zone defined by a second boundary plane and said inner boundary plane, the bulking planar zone including a portion of the first binder fibers, the second binder fibers, and the bulking fibers;

a first semi-rigid skin at the first boundary plane formed by melt bonding the first binder fibers on the first boundary plane of the first planar zone, the first skin comprising the first binder fibers and the first effect fibers;

wherein concentrations of the first binder fibers in said first planar zone being greater than concentrations of the first binder fibers in said bulking planar zone, and the concentration of the first binder fibers decreases in a gradient from the first boundary plane to the inner boundary plane; and wherein concentrations of said bulking fibers being greater in said bulking planar zone than the concentration of the bulking fibers in said first planar zone, and the concentration of bulking fibers decreases in a gradient from the second boundary plane to the inner boundary plane.

5. A non-woven material, comprising:

first binder fibers, first effect fibers, bulking fibers, and second binder fibers;

wherein the non-woven material being a unitary material formed in a single process without joining together discrete separate layers having:

a first planar zone defined by a first boundary plane and an inner boundary plane, the first planar zone including a portion of the first binder fibers, the first effect fibers, and the second binder fibers;

a bulking planar zone defined by a second boundary plane and said inner boundary plane, the bulking planar zone including a portion of the first binder fibers, the second binder fibers, and the bulking fibers;

a first semi-rigid skin at the first boundary plane formed by melt bonding the first binder fibers on the first boundary plane of the first planar zone, the first skin comprising the first binder fibers and the first effect fibers;

wherein concentrations of the first binder fibers in said first planar zone being greater than concentrations of the first binder fibers in said bulking planar zone, and the concentration of the first binder fibers decreases in a gradient from the first boundary plane to the inner boundary plane; and wherein concentrations of said second binder fibers being greater in said bulking planar zone than the concentration of the second binder fibers in said first planar zone, and the concentration of second binder fibers decreases in a gradient from the second boundary plane to the inner boundary plane.

6. The non-woven material according to claim 5, The non-woven according to claim 2, wherein the first planar zone includes a portion of the bulking fibers, the concentrations of said bulking fibers being greater in said bulking planar zone than the concentration of the bulking fibers in first planar zone, and the concentration of bulking fibers decreases in a gradient from the second boundary plane to the inner boundary plane.

7. A non-woven material, comprising:

first binder fibers, first effect fibers, bulking fibers, and second binder fibers;

wherein the non-woven material being a unitary material formed in a single process without joining together discrete separate layers having:

a first planar zone defined by a first boundary plane and an inner boundary plane, the first planar zone including a portion of the first binder fibers, the first effect fibers, and the bulking fibers;

a bulking planar zone defined by a second boundary plane and said inner boundary plane, the bulking planar zone including a portion of the first effect fibers, the second binder fibers, and the bulking fibers;

a first semi-rigid skin at the first boundary plane formed by melt bonding the first binder fibers on the first boundary plane of the first planar zone, the first skin comprising the first binder fibers and the first effect fibers;

wherein concentrations of the first effect fibers in said first planar zone being greater than concentrations of the first effect fibers in said bulking planar zone, and the concentration of the first effect fibers decreases in a gradient from the first boundary plane to the inner boundary plane; and wherein concentrations of said bulking fibers being greater in said bulking planar zone than the concentration of the bulking fibers in said first planar zone, and the concentration of bulking fibers decreases in a gradient from the second boundary plane to the inner boundary plane.

8. The non-woven according to claim 7, wherein the planar zone includes a portion of the first binder fibers, the concentrations of said first binder fibers being greater in said first planar zone than the concentration of the first binder fibers in bulking planar zone, and the concentration of first binder fibers decreases in a gradient from the first boundary plane to the inner boundary plane.

9. A non-woven material, comprising:

first binder fibers, first effect fibers, bulking fibers, and second binder fibers;

wherein the non-woven material being a unitary material formed in a single process without joining together discrete separate layers having:

a first planar zone defined by a first boundary plane and an inner boundary plane, the first planar zone including a portion of the first binder fibers, the first effect fibers, and the second binder fibers;

a bulking planar zone defined by a second boundary plane and said inner boundary plane, the bulking planar zone including a portion of the first effect fibers, the second binder fibers, and the bulking fibers;

a first semi-rigid skin at the first boundary plane formed by melt bonding the first binder fibers on the first boundary plane of the first planar zone, the first skin comprising the first binder fibers and the first effect fibers;

wherein concentrations of the first effect fibers in said first planar zone being greater than concentrations of the first effect fibers in said bulking planar zone, and the concentration of the first effect fibers decreases in a gradient from the first boundary plane to the inner boundary plane; and wherein concentrations of said second binder fibers being greater in said bulking planar zone than the concentration of the second binder fibers in said first planar zone, and the concentration of second binder fibers decreases in a gradient from the second boundary plane to the inner boundary plane.

10. The non-woven material according to claim 9, wherein the planar zone includes a portion of the first binder fibers, the concentrations of said first binder fibers being greater in said first planar zone than the concentration of the first binder fibers in bulking planar zone, and the concentration of first binder fibers decreases in a gradient from the first boundary plane to the inner boundary plane.

11. The non-woven according to claim 9, wherein the first planar zone includes a portion of the bulking fibers, the concentrations of said bulking fibers being greater in said bulking planar zone than the concentration of the bulking fibers in first planar zone, and the concentration of bulking fibers decreases in a gradient from the second boundary plane to the inner boundary plane.

12. The non-woven material according to claim 1, wherein the planar zone includes a portion of the first binder fibers, the concentrations of said first binder fibers being greater in said first planar zone than the concentration of the first binder fibers in bulking planar zone, and the concentration of first binder fibers decreases in a gradient from the first boundary plane to the inner boundary plane.

* * * * *